US007321664B2

(12) United States Patent
Van Banning et al.

(10) Patent No.: US 7,321,664 B2
(45) Date of Patent: Jan. 22, 2008

(54) RECEIVER HAVING AN IMPROVED BOBBIN

(75) Inventors: Stephan Olivier Van Banning, IJmuiden (NL); Alwin Fransen, Delft (NL); Paul Christiaan Van Hal, Amsterdam (NL)

(73) Assignee: SonionMicrotronic Nederland B.V., Amsterdam (NL)

( * ) Notice: Subject to any disclaimer, the term of this patent is extended or adjusted under 35 U.S.C. 154(b) by 165 days.

(21) Appl. No.: 10/756,589

(22) Filed: Jan. 13, 2004

(65) Prior Publication Data

US 2005/0152574 A1 Jul. 14, 2005

(51) Int. Cl.
*H04R 11/00* (2006.01)

(52) U.S. Cl. ..... 381/418; 381/412; 381/417

(58) Field of Classification Search ..... 381/396, 381/400, 403, 407, 408, 409, 410, 412, 417, 381/418, 419, 420, 421
See application file for complete search history.

(56) References Cited

U.S. PATENT DOCUMENTS

| | | | |
|---|---|---|---|
| 3,347,991 A | 10/1967 | Carlson | |
| 3,935,398 A | 1/1976 | Carlson et al. | |
| 4,025,884 A | 5/1977 | Wright et al. | |
| 4,272,654 A | 6/1981 | Carlson | |
| 6,078,677 A | 6/2000 | Dolleman et al. | |
| 6,757,403 B2 * | 6/2004 | Urushibata et al. | 381/418 |
| 6,853,735 B2 * | 2/2005 | Imahori et al. | 381/418 |
| 2001/0022844 A1 | 9/2001 | Urushibata et al. | |
| 2003/0094535 A1 | 5/2003 | Schmidt | |

FOREIGN PATENT DOCUMENTS

| | | |
|---|---|---|
| EP | 1 077 586 A2 | 2/2001 |
| EP | 1 219 135 B1 | 8/2003 |
| JP | 2001245390 A | 9/2001 |
| JP | 2001245398 A | 9/2001 |
| JP | 2001258094 A | 9/2001 |
| JP | 2001268692 A | 9/2001 |
| JP | 2002027598 A | 1/2002 |
| WO | WO-94/10817 | 5/1994 |
| WO | WO-01/26413 A2 | 4/2001 |
| WO | WO-01/26413 A3 | 4/2001 |
| WO | WO 01/69963 A2 | 9/2001 |

OTHER PUBLICATIONS

European Search Report issued Apr. 19, 2005.

* cited by examiner

*Primary Examiner*—Brian Ensey
(74) *Attorney, Agent, or Firm*—Nixon Peabody LLP.

(57) ABSTRACT

A receiver is disclosed for use in listening devices, such as hearing aids. The receiver comprises an electromagnetic drive assembly that includes a bobbin having a coil of conductive wire formed thereon. The bobbin is capable of compensating for the deflections on the armature that may be caused by shock. The bobbin is also capable of centering an armature leg within the coil.

8 Claims, 5 Drawing Sheets

RECEIVER HAVING AN IMPROVED BOBBIN

FIELD OF THE INVENTION

The present invention relates to miniature receivers used in listening devices, such as hearing aids. In particular, the present invention relates to miniature receivers that have an improved coil-receiving section.

BACKGROUND OF THE INVENTION

A conventional listening device such as a hearing aid includes, among other things, a microphone, an amplifier, and a receiver. The microphone receives an acoustic signal (i.e., sound waves) from the surrounding environment and converts the acoustic signal into an electrical signal. The electrical signal is then processed (e.g., amplified) by the amplifier and provided to the receiver. The receiver converts the processed electrical signal back into an acoustic signal and subsequently broadcast the acoustic signal to the eardrum.

A receiver for a conventional listening device is shown in FIG. 1. As can be seen, the receiver 100 includes a housing 102 that protects the sensitive components mounted inside the receiver 100. The housing 102 may be of a size and shape that allows the receiver 100 to be used in miniature listening devices, such as hearing aids. Within the housing 102 is mounted an electromagnetic drive assembly 104 that converts electrical signals from a microphone into acoustic signals. The electromagnetic drive assembly 104 includes, among other things, an armature 108 and an electrically conductive coil 110 through which the electrical signals from the microphone pass. Lead wires (not visible here) from the coil 110 extend through an opening in the housing 102 and terminate at a terminal 111 (e.g., a solder bump) on the outside of the receiver 100.

A magnet assembly 114 is also included in the electromagnetic drive assembly 104 adjacent to the coil 110. The magnet assembly 114 has a magnet housing composed of a pair of housing elements 116*a* and 116*b*. The housing elements 116*a* and 116*b* hold a pair of magnets (not visible here) that define a magnetic gap through which the working portion of the armature 108 extends.

In operation, an electrical signal passing through the coil 110 induces a magnetic field around the armature 108. Variations in the electrical signal produces fluctuations in the magnetic field, causing the armature 108 to alternate between moving toward one or the other of the magnets. A diaphragm 118 converts the armature movements, via a drive pin (not visible here), into a corresponding acoustic signal that is then broadcast to the eardrum.

The armature 108 is E-shaped, for example, with a base from which three parallel legs extend. Mounting of the armature 108 is such that the middle leg or reed of the armature passes through the center of the coil 110 along a central axis thereof, while the outer legs extend along the outside of the coil 110. The ends of the armature legs are then attached to the magnet assembly 114, which is adjacent to the coil 110.

Coil formation typically involves winding a conductive wire around a coil former. A coil winding bobbin may also be used to form the coil. Epoxy is usually applied to the coil to prevent corrosion. The coil former or coil winding bobbin is then removed using tweezers or other similar instruments. For an example of a coil winding bobbin that is removed, see European patent EP1219135B1. Removal of the coil former or coil winding bobbin, however, often produces inadvertent contact between the tweezers and the coil. This contact may cause damage to the epoxy, which can result in corrosion of the coil.

One solution to the above problem is to form the coil around a bobbin that is not removed. The middle armature leg or reed is then passed through the center of the bobbin and the outer legs extend along the outside. This solution, however, is lessened by the fact that it is usually very difficult to precisely center the middle armature leg within the bobbin. As a result, the inner height of the bobbin is typically made much larger than what is actually needed to accommodate the normal vibration of the armature leg.

Moreover, the armature 108 in the conventional receiver 100 is supported only at the ends of the legs where they are attached to the magnet assembly 114. The rest of the armature 108 is unsupported. As a result, large deflections may occur on the armature 108 when the receiver 100 is subjected to shock. A sufficiently severe shock may cause the armature 108 to deflect beyond the point of elastic deformation, thereby compromising the operation of the receiver 100.

Accordingly, what is needed is a receiver that is capable of inhibiting the large armature deflections that usually accompany a shock, and that is also capable of centering an armature leg within the coil of the receiver.

SUMMARY OF THE INVENTION

The present invention is directed to an improved receiver for use in listening devices, such as hearing aids. The receiver comprises an electromagnetic drive assembly that includes a bobbin having a coil of conductive wire formed thereon. The bobbin is capable of inhibiting the deflections on the armature that may be caused by shock. The bobbin is also capable of centering an armature leg within the coil.

In one embodiment, the receiver includes a magnet assembly, an armature having a moveable leg, and a coil assembly. The coil assembly includes a bobbin and a conductive wire wound around the bobbin. The coil assembly is adjacent to the magnet assembly and, together with the magnet assembly, defines a passage through which the moveable leg of the armature passes. The bobbin includes an inner surface defining the passage. The inner surface has at least one shock-absorbing structure for limiting a movement of the moveable leg within the passage when the receiver is subjected to shock.

In another embodiment, the receiver includes a magnet assembly, an armature having a moveable portion and a fixed portion, and a coil assembly. The coil assembly includes a bobbin and a conductive wire wound around the bobbin. The coil assembly is adjacent to the magnet assembly and, together with the magnet assembly, defines a passage through which the moveable leg passes. The bobbin includes an armature-mounting structure, usually in the form of slots in flanges of the bobbin. The moveable portion of the armature is substantially centered within the passage in response to the fixed portion being engaged to the armature-mounting structure.

The above summary of the present invention is not intended to represent each embodiment, or every aspect, of the present invention.

BRIEF DESCRIPTION OF THE DRAWINGS

The foregoing and other advantages of the invention will become apparent upon reading the following detailed description and upon reference to the drawings, wherein.

Figure 1:
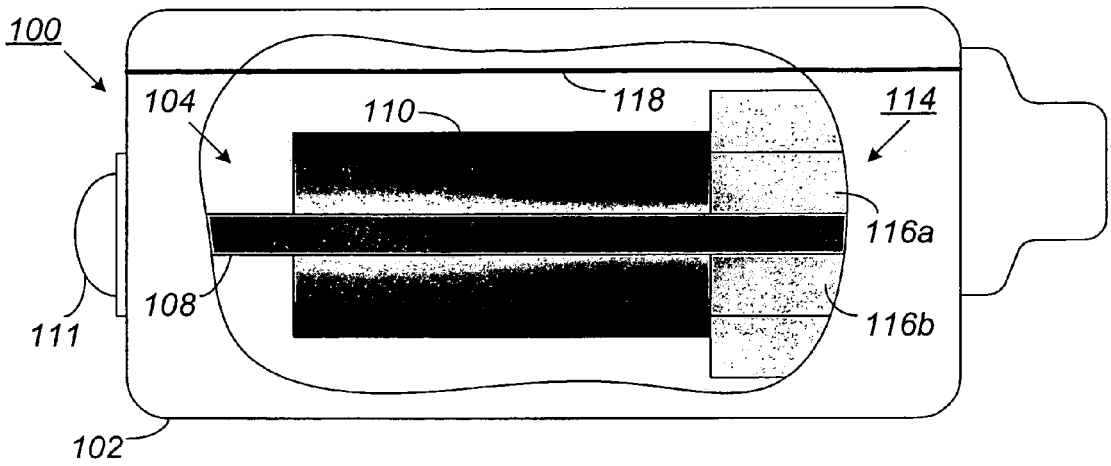
FIG. 1 (Prior Art)
FIG. 1 illustrates a cutaway view of a prior art receiver.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above with respect to prior art FIG. 1, conventional receivers typically employ coil formers or coil winding bobbins that are removed. In contrast, the receiver of the present invention uses a bobbin that is not removed. Thus, throughout the remainder of this description, the term "bobbin" will be used to refer to a bobbin that stays in the receiver.

Figure 2A:
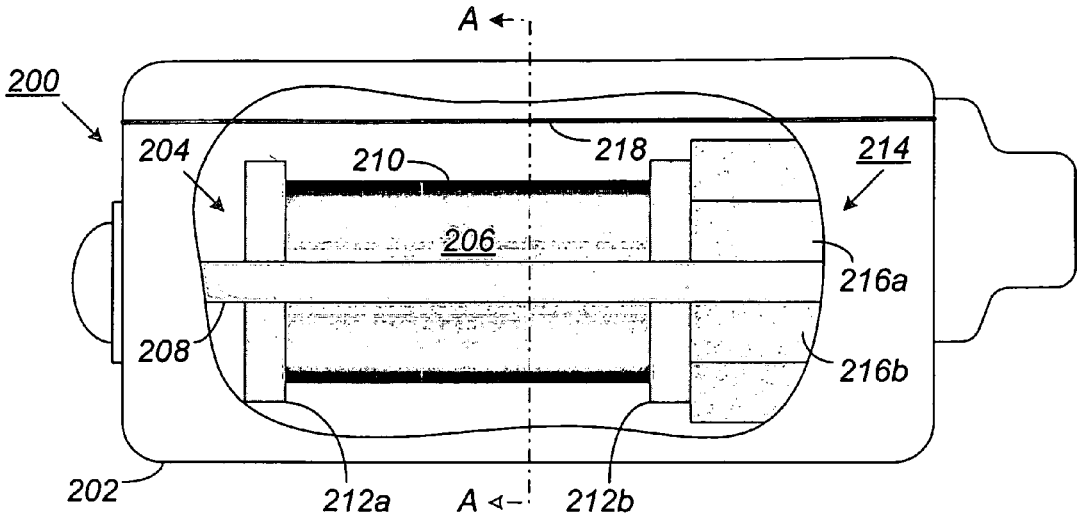
FIGS. 2A-2B illustrate a cutaway view and a cross-sectional view, respectively, of a receiver having a shock-absorbing bobbin according to embodiments of the invention.

Referring now to FIG. 2A, a cutaway view of a receiver 200 according to embodiments of the invention is shown. The receiver 200 has many of the same components found in the receiver 100 of FIG. 1, including a housing 202 that protects sensitive electronic components mounted inside the receiver 100. Within the housing 202 is mounted an electromagnetic drive assembly 204 that includes, among other things, a bobbin 206 and an armature 208 mounted on the bobbin 206. A coil 210 of conductive wire is wound around the bobbin 206 between a first flange 212*a* and a second flange 212*b* of the bobbin 206. The first and second flanges 212*a* and 212*b* serve as retainers for the coil 210 during formation thereof. A magnet assembly 214 is also included that comprises a pair of housing elements 216*a* and 216*b*. The housing elements 216*a* and 216*b* hold a pair of magnets (not visible here) that define a magnetic gap through which the working portion of the armature 208 extends. A diaphragm 218 converts the vibrations from the armature 208 via a drive pin (not visible here) into a corresponding acoustic signal that is then broadcast to the eardrum.

Figure 2B:
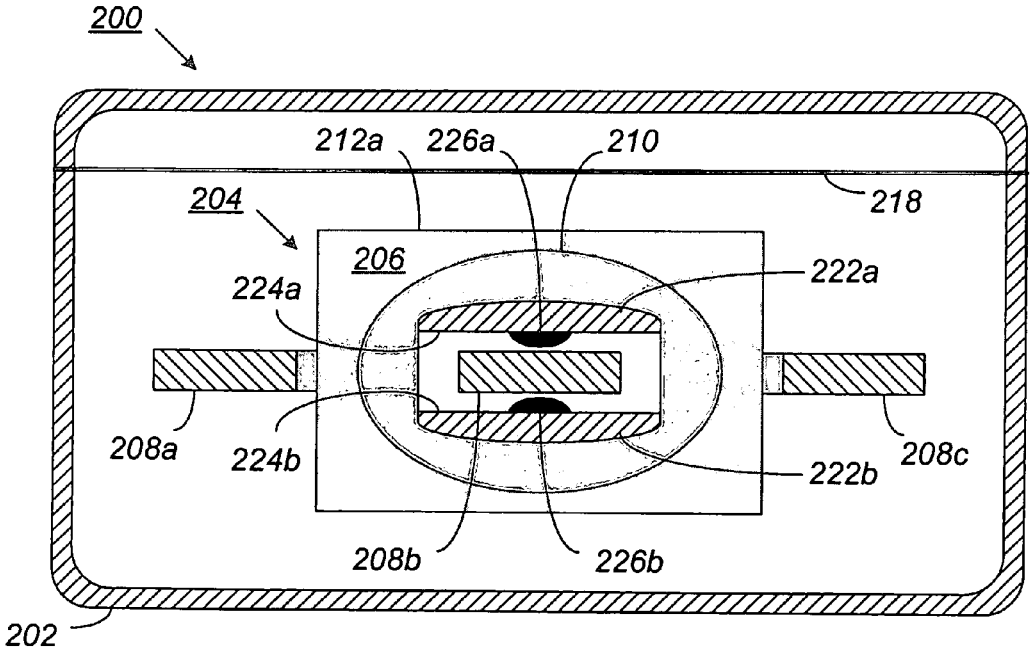

FIG. 2B illustrates a cross-sectional view of the receiver 200 taken along the line A-A in FIG. 2A. As can be seen in this view, the armature is an E-shaped armature with three parallel legs 208*a*, 208*b*, and 208*c*. The outer armature legs 208*a* and 208*c* extend along an outside of the bobbin 206, while the middle armature leg 208*b* or reed extends through a center longitudinal axis of the bobbin 206 and also through the magnetic gap defined by the pair of magnets that are adjacent to the bobbin 206. Note that although an E-shaped armature is used here, it is also possible to use other types of armatures (e.g., a single-leg armature or a U-shaped armature that has two legs) without departing from the scope of the invention.

The bobbin 206, meanwhile, includes a coil-receiving portion 222 that is made of parallel coil-receiving members 222*a* and 222*b*, which connect the two flanges 212*a* and 212*b* together. The coil 210 is then formed by winding a conductive wire around the coil-receiving members 222*a* and 222*b*. The coil-receiving members 222*a* and 222*b* have respective inner surfaces 224*a* and 224*b* that, together with the coil 210, define a passageway in the bobbin 206 through which the middle armature leg 208*b* extends. The bobbin 206 is made of a material, such as liquid crystal polymer (LCP), which will not affect the electromagnetic field produced by the coil. Other materials that may be used include, for example, a polyamide/nylon material, such as Stanyl®.

The inner surfaces 224*a* and 224*b* of the coil-receiving members 222*a* and 222*b* have one or more shock-absorbing structures 226*a* and 226*b* mounted thereon. The shock-absorbing structures 226*a* and 226*b* are preferably mounted substantially directly over the middle armature leg 208*b* on the respective inner surfaces 224*a* and 224*b* such that the structures can absorb any deflections that may occur on the middle armature leg 208*b*. In this way, the shock-absorbing structures 226*a* and 226*b* serve to limit the amount of deflection available to the middle armature leg 208*b* when the receiver 200 is subjected to shock.

Locating the shock-absorbing structures 226*a* and 226*b* on the coil-receiving members 222*a* and 222*b* has the advantage of ease of manufacture. It is also possible to locate the shock-absorbing structures 226*a* and 226*b* on the magnets. In general, however, it is preferable to keep the shape of the magnets as simple as possible because magnets are often tumbled or barrel polished, which may influence or alter the dimensions of any shock-absorbing structures that are formed on the magnets.

In some embodiments, there is a slight gap between the middle armature leg 208*b* and each shock-absorbing structure 226*a* and 226*b*. The gap on one side of the middle armature leg 208*b* may or may not be the same size as the gap on the other side, depending on whether the middle armature leg 208*b* is centered or off-center within the bobbin 206. It is also possible to have no gap, i.e., the middle armature leg 208*b* is in direct contact with one or both of the shock-absorbing structures 226*a* and 226*b* so long as the structures are sufficiently elastic to allow the armature to perform its function.

As for the composition of the shock-absorbing structures 226*a* and 226*b*, these structures may be made of any suitable shock-absorbing material. For example, in some embodiments, the shock-absorbing structures 226*a* and 226*b* may be made of an elastomeric material, such as a silicon based adhesive. In other embodiments, the shock-absorbing structures 226*a* and 226*b* may be formed from drops of a cured adhesive. One example of such a cured adhesive is the UV-cured adhesive OG115 from Epoxy Technology, Inc. of Billerica, Mass., with a Shore D hardness of approximately 86. In still other embodiments, the shock-absorbing structures 226*a* and 226*b* are integrally formed on the bobbin 206 and, thus, made from the same material as the bobbin 206.

Figure 3:
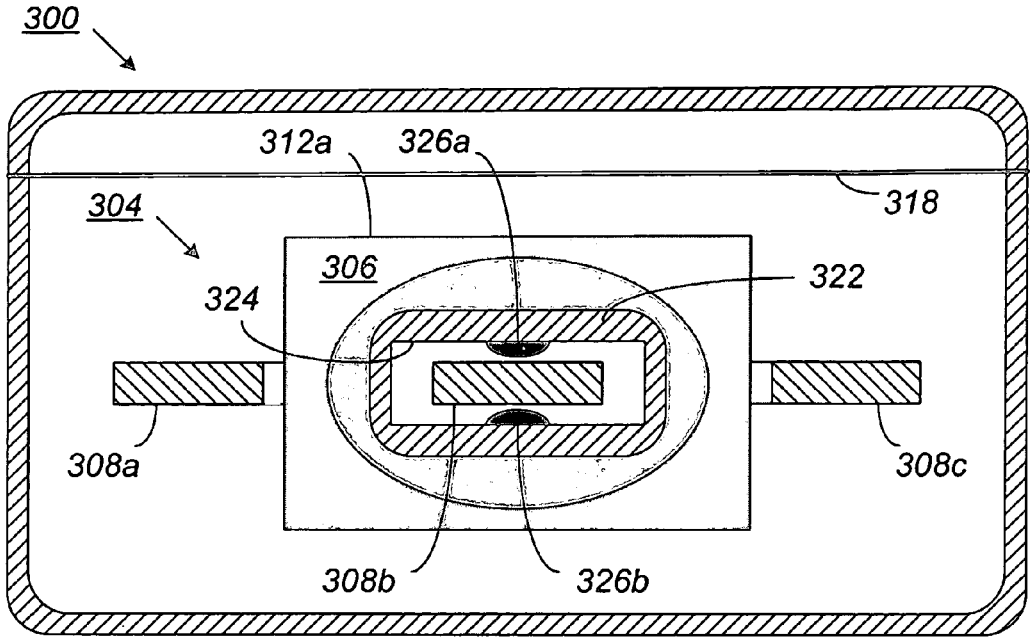
FIG. 3 illustrates a cross-sectional view of a receiver having another shock-absorbing bobbin according to another embodiment of the invention.

FIG. 3 illustrates a cross-sectional view of a receiver 300 having an electromagnetic drive assembly 304 according to embodiments of the invention. The electromagnetic drive assembly 304 is similar to the electromagnetic drive assembly 204 of FIGS. 2A-2B, except that it has a bobbin 306 which includes a substantially tubular coil-receiving portion 322 (the outer armature legs 308*a* and 308*c*, flanges 312*a* and 312*b* (only 312*a* visible here), and diaphragm 318 are similar to their counterparts 208*a*, 208*c*, 212*a*, 212*b*, and 218 in FIGS. 2A-2B). The result is that an inner surface 324 of the coil-receiving portion 322 alone defines the entire passageway in the bobbin 306. This is different from the previous embodiment in which the coil 210 and the coil-receiving members 222*a* and 222*b* together define the passageway. Such a coil-receiving portion 322 may also help improve the stiffness of the bobbin 306. Shock-absorbing structures 326*a* and 326*b* are then mounted on opposing sides of the inner surface 324 of the unitary coil-receiving portion 322 substantially directly over the middle armature leg 308*b* such that the structures can absorb the deflections that may occur on the armature leg.

Figure 4:
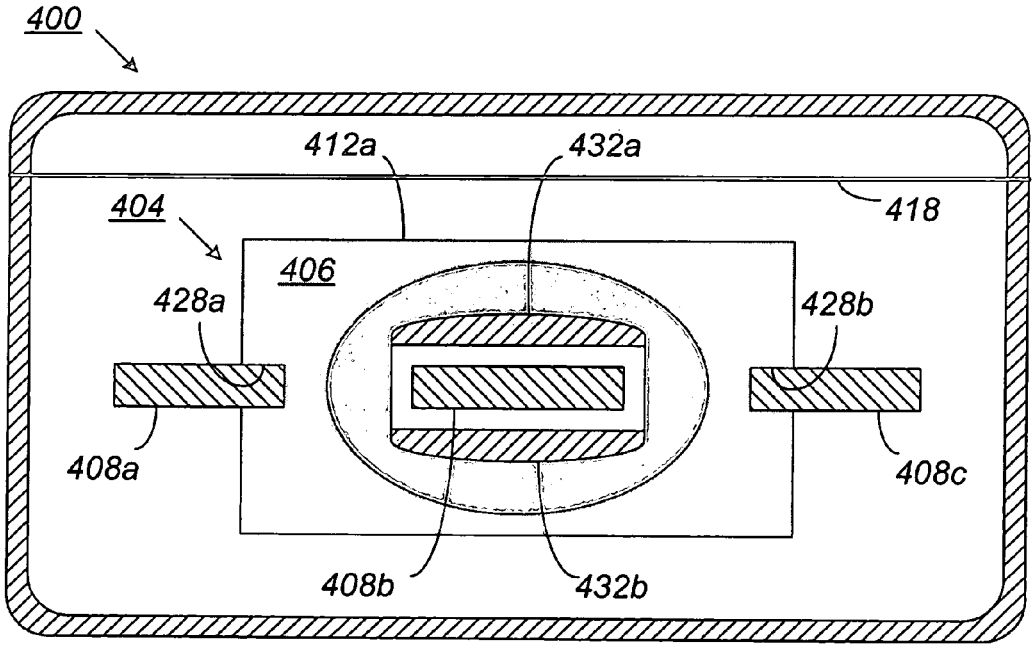
FIG. 4 illustrates a cross-sectional view of a receiver having an armature-centering bobbin according to yet another embodiment of the invention.

In some embodiments, instead of (or in addition to) the shock-absorbing structures, the bobbin may include an armature support structure that helps brace or stiffen the outer armature legs and also helps suppress the deflections that may occur on the armature legs. FIG. 4 illustrates a cross-sectional view of a receiver 400 having an electromagnetic drive assembly 404 with an exemplary armature support structure on the bobbin. The electromagnetic drive assembly 404 is similar to the electromagnetic drive assembly 204 of FIGS. 2A-2B, except that it has a bobbin 406 which includes armature-mounting slots 428*a* and 428*b* (the coil-receiving members 432*a* and 432*b* and diaphragm 418 are similar to their counterparts 222*a*, 222*b*, and 218 in FIGS. 2A-2B). These armature-mounting slots 428*a* and 428*b* are formed on the flanges 412*a* and 412*b* (only one shown in FIG. 4) on the sides thereof that are substantially perpendicular to the plane of the armature (one slot on each side).

The armature-mounting slots 428*a* and 428*b* are designed to receive at least a portion of the outer armature legs 408*a* and 408*c* and to provide bracing and stiffness support for the outer armature legs 408*a* and 408*c*. To this end, the size and shape of the armature-mounting slots 428*a* and 428*b* should be of a dimension such that at least a portion of each outer armature leg 408*a* and 408*c* can fit snugly in one of the armature-mounting slots 428*a* and 428*b*. Likewise, the flanges 412*a* and 412*b* should have a width that is large enough to intersect at least a portion of the outer armature legs 408*a* and 408*c*. When the outer armature legs 408*a* and 408*c* are properly engaged in the armature-mounting slots 428*a* and 428*b*, the armature becomes supported at more than one place. This additional support provides improved stiffness for the outer armature legs 408*a* and 408*c* and, to a lesser degree, the middle armature leg 408*b* as well.

In addition to improving stiffness, the support provided by the armature-mounting slots 428*a* and 428*b* also helps dampen the deflections that may be present on the outer armature legs 408*a* and 408*c*. Dampening of deflections may also take place on the middle armature leg 408*b*, although to a lesser degree. As a result, it may not be necessary to provide a separate set of shock-absorbing structures to compensate for deflection on the armature legs, although it is certainly possible to have both.

Furthermore, the armature-mounting slots 428*a* and 428*b* also have the effect of automatically centering the middle armature leg 408*b* within the bobbin 406. The reason is because the interlocking of the outer armature legs 408*a* and 408*c* with the armature-mounting slots 428*a* and 428*b* naturally forces the middle armature leg 408*b* to be located in a certain position. By selecting the proper placement for the armature-mounting slots 428*a* and 428*b* on the flanges 412*a* and 412*b*, the middle armature leg 408*b* can be automatically positioned in the center on the bobbin 406. This reduces the need to overcompensate for an off-center annature leg by, for example, providing extra room between the armature leg 408*b* and the inner surface of the coil-receiving members 422*a* and 422*b*. The self-centering armature also results in a receiver that is easier to manufacture than existing receivers.

Figure 5:
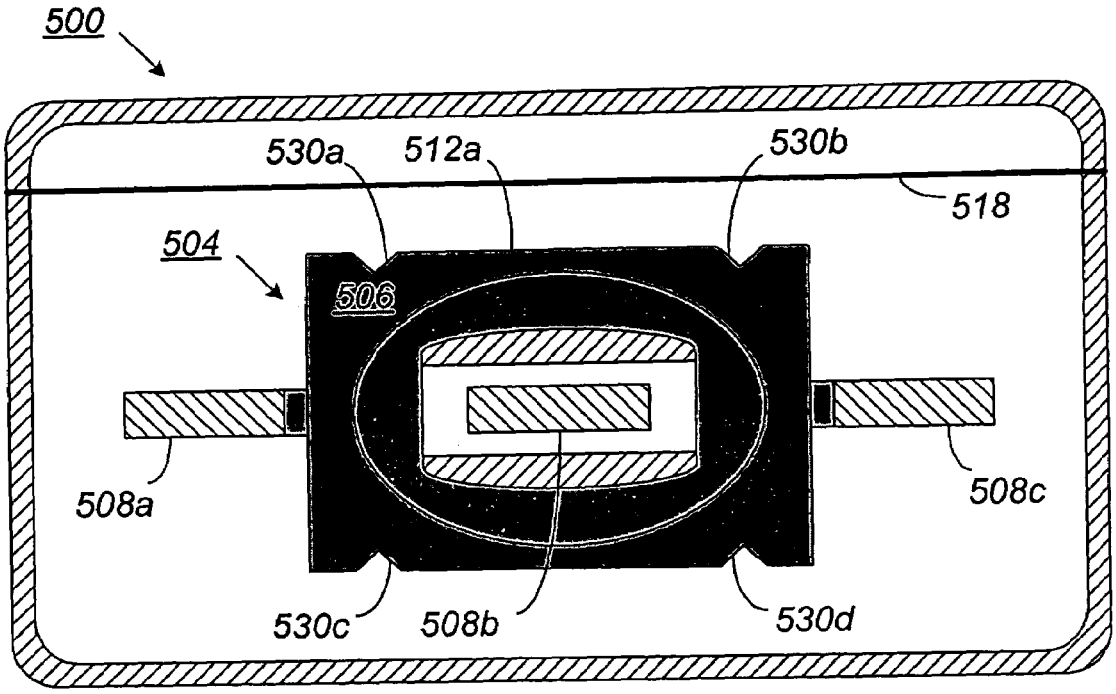
FIG. 5 illustrates a cross-sectional view of a receiver having a wire guiding bobbin according to a further embodiment of the invention.

In some embodiments, the bobbin may include wire guides for guiding the lead wires of the coil that is formed on the bobbin. Referring now to FIG. 5, a receiver 500 having an electromagnetic drive assembly 504 with exemplary wire guides provided on the bobbin is shown. The electromagnetic drive assembly 504 is similar to the electromagnetic drive assembly 204 of FIGS. 2A-2B, except that it has a bobbin 506 which includes wire guides 530*a*-530*d* (the outer armature legs 508*a* and 508*c* and diaphragm 518 are similar to their counterparts 208*a*, 208*c*, and 218 in FIGS. 2A-2B). The wire guides 530*a*-530*d* are formed as V-shaped grooves on one of the flanges 512*a* and 512*b* of the bobbin 506 and serve to guide the lead wires of the coil. Although there are four wire guides 530*a*-530*d* shown here, in practice, there may be more or fewer wire guides as needed, depending on the particular application. Also, the wire guides 530*a*-530*d* may be formed on one or on both flanges 512*a* and 5l2*b* (only 512*a* visible here), as needed. While a V-shaped groove is shown, other shape grooves may certainly be used, such as circular or rectangular grooves. Additionally, in some embodiments, a drop of adhesive may be placed in the grooves 530*a*-530*d* to help keep the lead wires in place on the flanges 512*a* and 512*b*.

Figure 6:
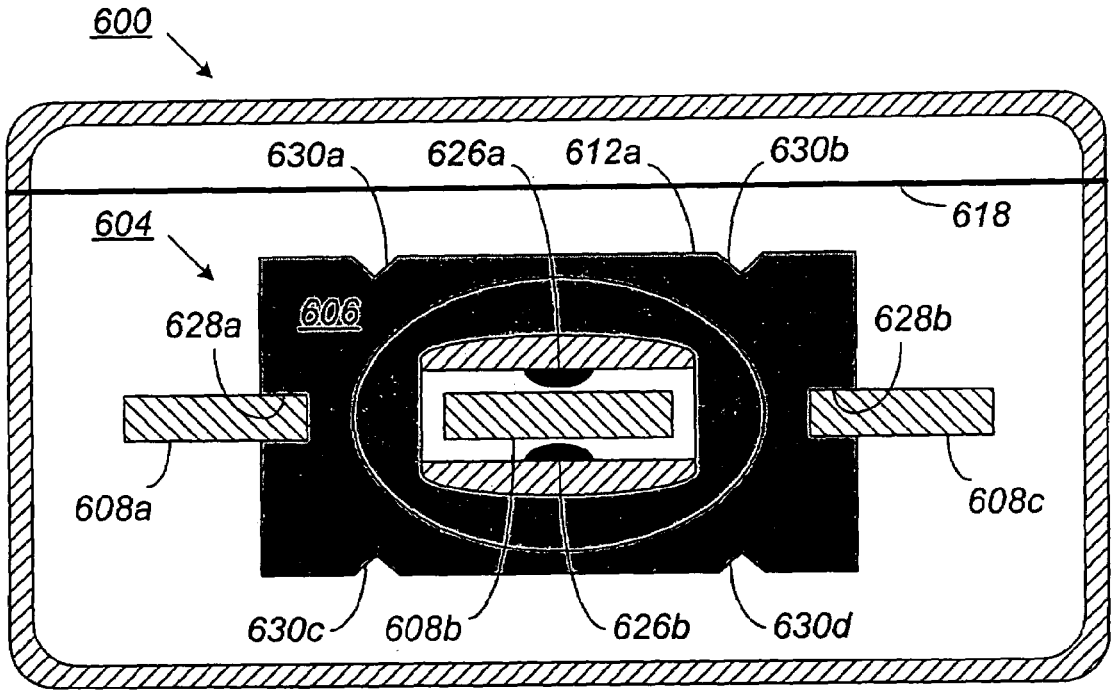
FIG. 6 illustrates a cross-sectional view of a receiver having a shock-absorbing, armature-centering, and wire guiding bobbin according to yet another embodiment of the invention.

Although they have been discussed separately thus far, all of the features above may be combined into a single receiver. FIG. 6 illustrates a cross-sectional view of a receiver 600 in which the electromagnetic drive assembly 604 has all of the features discussed above with respect to FIGS. 2A-2B and 3-5. The electromagnetic drive assembly 604 is similar to the electromagnetic drive assembly 204 of FIGS. 2A-2B, except that it has a bobbin 606 which includes shock-absorbing structures 626*a* and 626*b*, armature-mounting slots 628*a* and 628*b*, and wire guides 630*a*-630*d* (the armature legs 608*a*, 608*b*, and 608*c*, flanges 612*a* and 612*b* (see FIG. 7), and diaphragm 618 are similar to their counterparts 208*a*, 208*b*, 208*c*, 212*a*, 212*b*, and 218 in FIGS. 2A-2B). These features result in a receiver 600 that may be more shock resistant (because of the shock-absorbing structures), is easier to manufacture (by virtue of the self-centering armature), as well as more reliable (due to less handing of the coil and wires, since the bobbin can be handled now during manufacturing).

Figure 7:
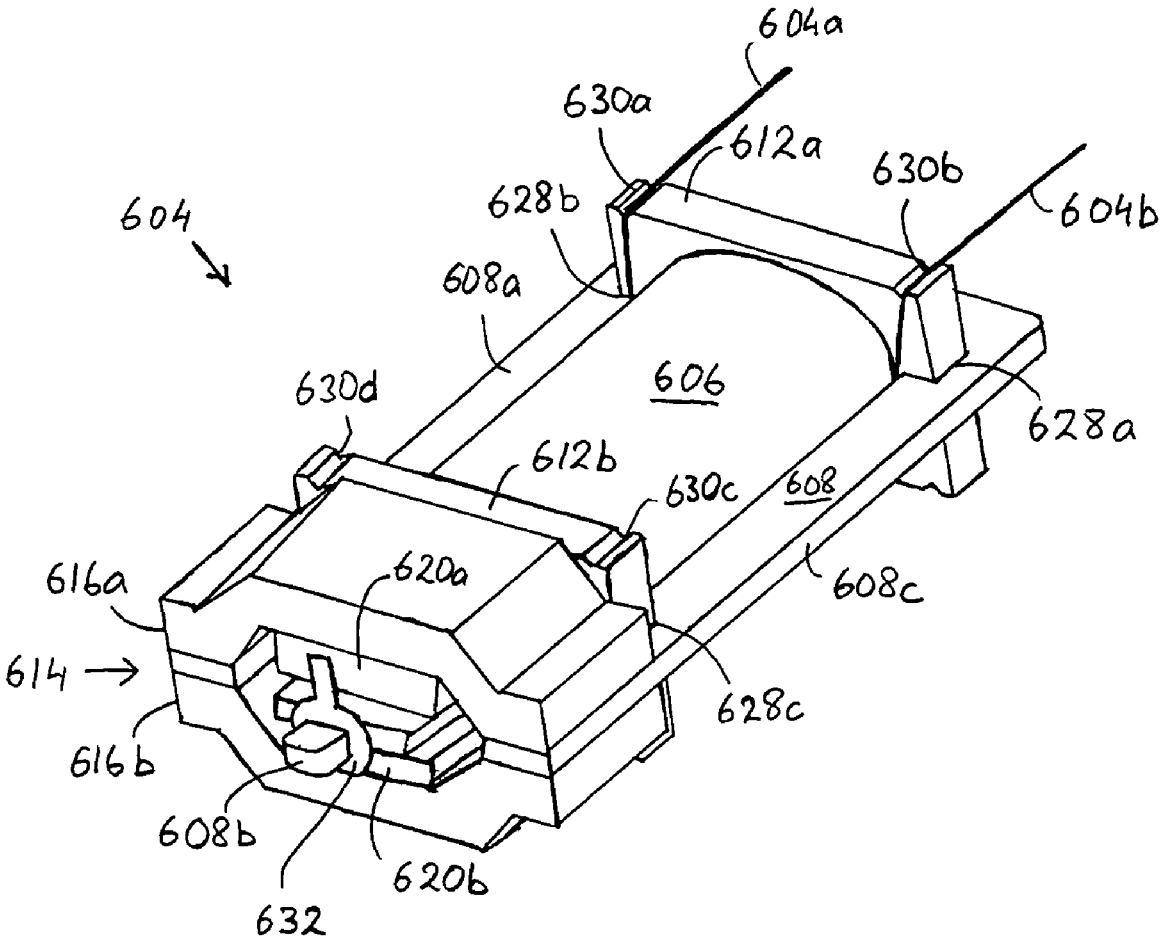
FIG. 7 illustrates a perspective view of an electromagnetic drive assembly according to embodiments of the invention.

FIG. 7 illustrates a perspective view of the electromagnetic drive assembly 604 of FIG. 6. The electromagnetic drive assembly 604 includes the E-shaped armature 608 engaged to the bobbin 606 (although any of the bobbins previously discussed may be used). As a result, the electromagnetic drive assembly 604 enjoys the benefit of being more resistant to shock, having a self-aligning armature, as well as making it easier to retain the lead wires. The electromagnetic drive assembly 604 further includes a magnet assembly 614 that is similar to the magnet assembly 214 of FIG. 2A. The magnet assembly 614 is composed of magnet housings 616*a* and 616*b*, and magnets 620*a* and 620*b* that are housed within the magnet housing 616*a* and 616*b*. Outer armature legs 608*a* and 608*c* are then clamped between the magnet housing 616*a* and 616*b*. The coil assembly, which includes the bobbin 606 and its coiled wire, and the magnet assembly 614 define a passageway through which the moveable middle leg 608*b* of the armature 608 passes.

The magnet housing 616*a* and 616*b* help to position (i.e., balance) the armature 608 in the middle of the passageway of the coil and in the magnet gap between the magnets 620*a* and 620*b*. A drive pin 632 is connected to the armature 608 on one end and a diaphragm 618 (see FIG. 6) on the other end. When the coil receives a drive signal via lead wires 604*a* and 604*b*, the coil is energized in a manner that causes a known movement in the armature 608 and, thus, a known acoustic output from the diaphragm 618. The details of the function and operation of these components are well known to one having ordinary skill in this art and, therefore, will not be described here. Lead wires 604*a* and 604*b* are disposed in and retained by the V-shaped wire guides 630*a*-530*b* of the bobbin 606. Such an electromagnetic drive assembly 604 may be used in any miniature receiver of the type commonly employed in listening devices, such as hearing aids.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A receiver for a listening device, comprising:

a magnet assembly;

an armature having a moveable portion and a fixed portion; and a coil assembly including a bobbin and a conductive wire wound around said bobbin, said coil assembly being adjacent to said magnet assembly and, together with said magnet assembly, defining a passage through which said moveable portion passes, said bobbin including an armature-mounting structure configured to interlock with said fixed portion of said armature such that said moveable portion of said armature is substantially centered within said passage in response to said fixed portion being interlocked with said armature-mounting structure.

2. The receiver according to claim 1, wherein said bobbin includes first and second flanges and said armature-mounting structure is formed on opposing edges of said first and second flanges, each opposing edge lying in a plane that is substantially perpendicular to a plane of said armature.

3. The receiver according to claim 1, wherein said armature-mounting structure has a shape that substantially matches a shape of said fixed portion of said armature.

4. The receiver according to claim 1, wherein said armature is an E-shaped armature.

5. A receiver for a listening device, comprising:

a magnet assembly;

an armature having a moveable portion and a fixed portion; and a coil assembly including a bobbin and a conductive wire wound around said bobbin, said coil assembly being adjacent to said magnet assembly and, together with said magnet assembly, defining a passage through which said moveable portion passes, said bobbin including an armature-centering structure configured to interlock said fixed portion of said armature such that said moveable portion of said armature is substantially centered within said passage in response to said fixed portion being interlocked with said armature-centering structure.

6. The receiver according to claim 1, wherein said bobbin includes first and second flanges and said armature-mounting structure includes grooves formed in opposing edges of said first and second flanges.

7. The receiver according to claim 6, wherein said armature is a planar armature and each opposing edge lies in a plane that is substantially perpendicular to a plane of said armature.

8. A receiver for a listening device, comprising:

a magnet assembly;

an armature having a moveable portion and a fixed portion; and a coil assembly including a bobbin and a conductive wire wound around said bobbin, said coil assembly being adjacent to said magnet assembly and, together with said magnet assembly, defining a passage through which said moveable portion passes, said bobbin including an armature-mounting structure configured to engage said fixed portion of said armature such that said moveable portion of said armature is substantially within said passage in response to said fixed portion being engaged said armature-mounting structure, said bobbin including first and second flanges and said armature-mounting structure is formed on opposing edges of said first and second flanges, each opposing edge lying in a plane that is substantially perpendicular to a plane of said armature.

* * * * *